US009913508B2

(12) United States Patent
Tzeng

(10) Patent No.: US 9,913,508 B2
(45) Date of Patent: Mar. 13, 2018

(54) FOOT BALANCING DEVICE

(71) Applicant: Varithotics Co., Ltd., Taipei (TW)

(72) Inventor: Tzann-Yuh Tzeng, Taipei (TW)

(73) Assignee: VARITHOTICS CO., LTD., Taipei (TW)

( * ) Notice: Subject to any disclaimer, the term of this patent is extended or adjusted under 35 U.S.C. 154(b) by 0 days.

(21) Appl. No.: 14/613,711

(22) Filed: Feb. 4, 2015

(65) Prior Publication Data

US 2015/0143714 A1 May 28, 2015

Related U.S. Application Data

(63) Continuation-in-part of application No. 13/223,278, filed on Aug. 31, 2011, now abandoned.

(51) Int. Cl.

| | |
|---|---|
| ***A43B 1/00*** | (2006.01) |
| ***A43B 7/14*** | (2006.01) |
| ***A43B 13/38*** | (2006.01) |
| ***A43B 19/00*** | (2006.01) |

(52) U.S. Cl.

CPC ..... *A43B 1/0081* (2013.01); *A43B 7/142* (2013.01); *A43B 7/143* (2013.01); *A43B 7/1405* (2013.01); *A43B 7/1465* (2013.01); *A43B 13/38* (2013.01); *A43B 19/005* (2013.01)

(58) Field of Classification Search

CPC ..... A43B 7/14; A43B 7/141; A43B 7/142; A43B 7/1415; A43B 7/146; A43B 7/143; A43B 7/1445; A43B 7/149

USPC ..... 36/44, 43, 141, 145, 174

See application file for complete search history.

(56) References Cited

U.S. PATENT DOCUMENTS

| | | | | |
|---|---|---|---|---|
| 1,578,715 A | | 3/1926 | Cooke | |
| 1,866,598 A | * | 7/1932 | Johnson | A43B 7/142 36/162 |
| 2,090,881 A | * | 8/1937 | Wilson | A43B 13/20 36/29 |
| 4,033,054 A | | 7/1977 | Fukuoka | |
| 4,045,886 A | * | 9/1977 | Terasaki | A43B 7/142 36/44 |
| 4,112,599 A | * | 9/1978 | Krippelz | A43B 13/20 36/11.5 |
| 4,760,655 A | | 8/1988 | Mauch | |

(Continued)

*Primary Examiner* — Khoa Huynh
*Assistant Examiner* — Megan Lynch
(74) *Attorney, Agent, or Firm* — Juan Carlos A. Marquez; Marquez IP Law Office, PLLC

(57) ABSTRACT

A foot balancing device includes a shoe insert, a main balancing element, three auxiliary force-transferring elements, and three auxiliary balancing elements. The main balancing element is provided in an arch region of the shoe insert and serves as a fulcrum on the shoe insert for the front part of the sole of one of the user's feet and the heel of the foot. The auxiliary force-transferring elements are provided in the arch region of the shoe insert so that the pressure center of the sole will displace along an ideal line. The auxiliary balancing elements are located forward of and on two lateral sides of the main balancing element respectively to support a transverse arch, inner arch, and outer arch of the foot respectively. Thus, the user's body weight can distribute evenly over the sole while the user is standing or walking, thereby preventing injury resulting from improper posture.

13 Claims, 13 Drawing Sheets

(56) References Cited

U.S. PATENT DOCUMENTS 4,831,749 A * 5/1989 Tsai ..... A43B 17/08 36/141
4,843,738 A * 7/1989 Masuda ..... A43B 1/0054 36/43
5,400,526 A * 3/1995 Sessa ..... A43B 1/0045 36/141
D373,013 S * 8/1996 Rosetta ..... D2/961
5,553,398 A 9/1996 Schnewlin-Maier
5,685,094 A * 11/1997 Lin ..... A43B 1/0054 36/141
5,784,811 A * 7/1998 Mauch ..... A43B 1/0054 36/141
5,860,229 A * 1/1999 Morgenstern ..... A43B 7/1415 36/141
5,894,687 A * 4/1999 Lin ..... A43B 7/146 36/141
5,915,820 A * 6/1999 Kraeuter ..... A43B 5/00 36/102
5,976,100 A * 11/1999 Greenawalt ..... A43B 1/0054 36/43
6,141,890 A * 11/2000 Chtn ..... A43B 3/12 36/141
6,510,626 B1 * 1/2003 Greenawalt ..... A43B 7/142 36/160
6,845,573 B2 * 1/2005 Litchfield ..... A43B 13/203 36/141
7,373,740 B2 5/2008 Lo
7,784,196 B1 * 8/2010 Christensen ..... A43B 13/184 36/29
7,900,380 B2 3/2011 Rich
2002/0014024 A1 2/2002 Gardiner
2002/0184791 A1 * 12/2002 Ko ..... A43B 3/105 36/8.1
2003/0140524 A1 * 7/2003 Robinson, Jr. ..... A43B 7/142 36/44
2004/0000076 A1 * 1/2004 Celmo ..... A43B 7/1465 36/141
2004/0103558 A1 * 6/2004 Everz ..... A43B 7/1415 36/43
2004/0111924 A1 * 6/2004 Riccardi ..... A43B 7/1465 36/141
2005/0268490 A1 * 12/2005 Foxen ..... A43B 7/1425 36/28
2006/0112600 A1 6/2006 Khoury
2006/0185196 A1 * 8/2006 Wang ..... A43B 7/146 36/141
2006/0277794 A1 * 12/2006 Schindler ..... A43B 7/144 36/28
2007/0169376 A1 * 7/2007 Hatfield ..... A43B 7/1415 36/29
2008/0289217 A1 * 11/2008 Horvath ..... A43B 3/108 36/88
2009/0038179 A1 * 2/2009 Chen ..... A43B 17/003 36/41
2009/0049712 A1 2/2009 Steszyn et al.
2009/0056171 A1 * 3/2009 Lin ..... A43B 7/146 36/3 B
2009/0076424 A1 * 3/2009 Sim ..... A43B 7/142 601/151
2009/0172972 A1 7/2009 Rosen
2010/0050472 A1 3/2010 Tzeng et al.
2010/0058540 A1 3/2010 Calvert
2010/0132222 A1 * 6/2010 Kawahara ..... A43B 7/142 36/91
2011/0173842 A1 * 7/2011 Hong ..... A43B 7/142 36/91
2011/0203134 A1 * 8/2011 Sartor ..... A43B 7/1415 36/29
2011/0289798 A1 * 12/2011 Jung ..... A43B 7/142 36/91
2012/0144697 A1 * 6/2012 Everz Vaz ..... A43B 7/146 36/44
2012/0151794 A1 * 6/2012 Hansen ..... A43B 7/143 36/43
2012/0233885 A1 * 9/2012 Shaffer ..... A43B 13/20 36/103
2013/0111781 A1 * 5/2013 Jaeger ..... A43B 3/0052 36/43
2013/0160331 A1 * 6/2013 Burke ..... A43B 13/14 36/25 R
2013/0239435 A1 * 9/2013 McDowell ..... A43B 3/108 36/11.5

* cited by examiner

FOOT BALANCING DEVICE

CROSS-REFERENCE TO RELATED APPLICATIONS

The present application is a continuation-in-part of U.S. application Ser. No. 13/223,278 filed Aug. 31, 2011, titled "Foot Balance Device", the disclosure of which is hereby incorporated by reference herein.

BACKGROUND OF THE INVENTION

1. Technical Field

The present invention relates to a foot balancing device and, more particularly, to a foot balancing device which enables uniform distribution of a user's body weight over the feet while the user is standing or walking.

2. Description of Related Art

With the development and progress of economy, people nowadays have far fewer opportunities for physical labor than before, and a lack of physical activities has increased the chances of various diseases of affluence significantly.

On the other hand, chronic pain resulting from improper posture is common to many, if not more common than the diseases of affluence. The main causes of chronic pain are improper body movements and postures which drive the bones and muscles out of balance. From the viewpoint of biological evolution, humans evolved from quadrupedalism to bipedalism. In order to keep balance while standing or walking on two feet in an erect position, the bones and muscles must coordinate with one another; hence, substitution and compensation between the bones and muscles take place to prevent one from tumbling in a standing state or allow one to continue walking in an upright position.

The aforesaid substitution and compensation involve interactions between different bones and muscles, and it is these interactions that make possible the various types of improper body movements and postures when one is standing or walking. Such improper movements and postures, in turn, unbalance the bones and muscles and eventually give rise to chronic pain and all kinds of soreness.

As the chronic pain and soreness mentioned above stem from substitution and compensation within the human body as a whole, no easy medical solution is available, despite the highly developed modern medicine. Neither can the human body itself effectively avoid improper movements or postures to prevent chronic pain and soreness.

To alleviate the discomfort caused by chronic pain, it is most desirable that the body weight of a person in a standing position is evenly distributed between the heel and the front part of the sole of each foot, and that consequently the center of pressure of each sole lies at the center of the sole. Only when one's body weight is evenly supported by the feet can the bone and muscle systems maintain neutral balance while standing or walking. Under normal circumstances, however, the center of pressure of a sole in a standing position tends to be located either backward or forward of the center of the sole as a result of shoe design. If the center of pressure is shifted backward, the heel bears a greater part of the body weight and therefore may be painful and cause to wear away the heel of the shoe. If the center of pressure is shifted forward, it is the front part of the sole that bears a greater part of the body weight, and a forward impetus is generated when walking.

Conventional solutions to the foregoing problems include adding a post in the shoe structure; making a hole in the heel of a shoe and filling the hole with a soft, resilient material; and putting a well-shaped heel cup in a shoe. These solutions nevertheless tend to apply more force to the heel or sole of a foot and therefore fail to provide effective improvement. A further study reveals that, while the post, the soft material, and the heel cup help adjust improper body movement or posture arising from an uneven distribution of body weight between the heel and the front part of the sole of each foot, they are ineffective in reducing the pressure on the heel or the front part of the sole.

BRIEF SUMMARY OF THE INVENTION

The present invention provides a foot balancing device in which a shoe insert is provided with a main balancing element corresponding in position to the gravity center of the user's body while the user is standing and serving as a fulcrum on the shoe insert for the front part of the sole of one of the user's feet and the heel of the foot. The shoe insert is also provided with a plurality of auxiliary force-transferring elements and auxiliary balancing elements to help distribute the user' body weight over the shoe insert in a natural manner. Thus, while the user is standing or walking, his or her body weight will be evenly distributed on the feet, and injuries associated with improper posture are prevented.

The present invention provides a foot balancing device, comprising: a shoe insert having a foot contact surface and a bottom surface, the shoe insert defining a front-of-sole region, an arch region, and a heel region sequentially arranged in a longitudinal direction of the shoe insert; a main balancing element formed as a protuberance in the arch region and serving as a fulcrum on the shoe insert for a front part of the sole of one of a user's feet and the heel of the foot; a first auxiliary force-transferring element formed as a protuberance in the arch region and located rearward of the main balancing element and adjacent to the heel region; a second auxiliary force-transferring element formed as a protuberance in the arch region and located on a line connecting the main balancing element and the first auxiliary force-transferring element; a first auxiliary balancing element formed as a protuberance in the arch region and located forward of the main balancing element in order to support a transverse arch of the foot; a third auxiliary force-transferring element formed as a protuberance in the arch region and located between the first auxiliary balancing element and the main balancing element; a second auxiliary balancing element formed as a protuberance in the arch region and located on a lateral side of the main balancing element in order to support an inner arch of the foot; and a third auxiliary balancing element formed as a protuberance in the arch region and located on an opposite lateral side of the main balancing element in order to support an outer arch of the foot.

The present invention also provides a foot balancing device, comprising: a shoe insert having a foot contact surface and a bottom surface, the shoe insert defining a front-of-sole region, an arch region, and a heel region sequentially arranged in a longitudinal direction of the shoe insert; and a main balancing element formed as a protuberance in the arch region and serving as a fulcrum on the shoe insert for a front part of the sole of one of a user's feet and the heel of the foot.

Implementation of the present invention at least provides the following advantageous effects:

1. Allowing the user's body weight to distribute on the feet in a natural manner so that the user can stand or walk in an ideal position; and 2. Preventing soreness and chronic pain caused by improper posture.

The detailed features and advantages of the present invention will be described in detail with reference to the preferred embodiments so as to enable persons skilled in the art to gain insight into the technical disclosure of the present invention, implement the present invention accordingly, and readily understand the objectives and advantages of the present invention by perusal of the contents disclosed in the specification, the claims, and the accompanying drawings.

DETAILED DESCRIPTION OF THE INVENTION

Figure 1:
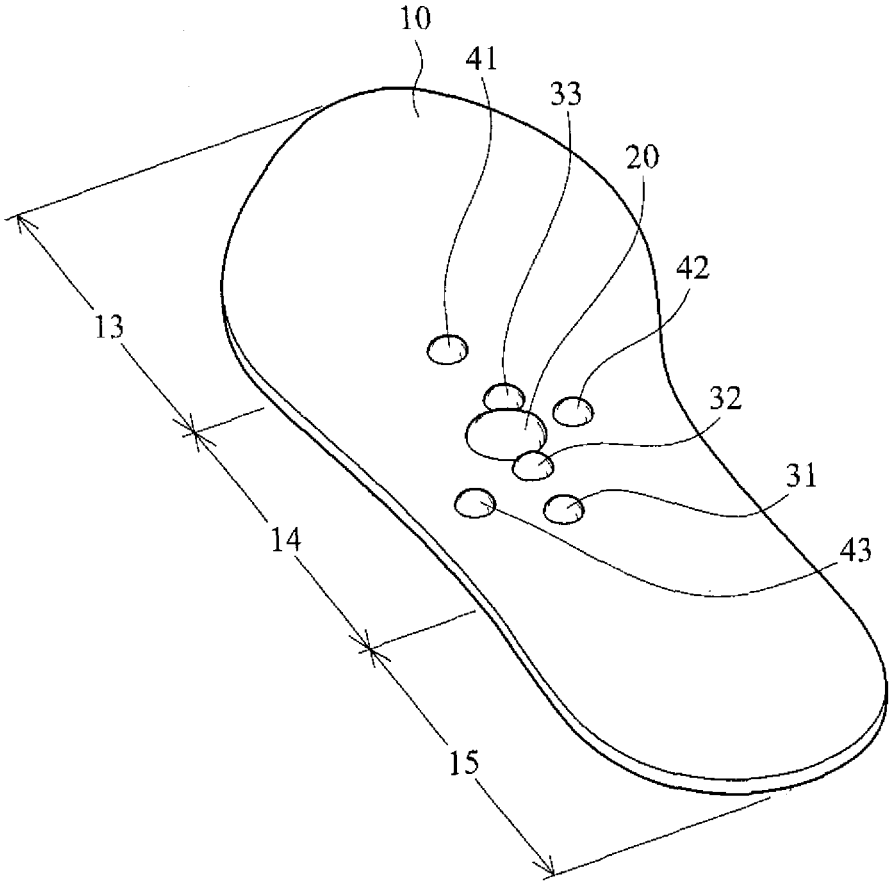
FIG. 1 schematically shows the foot balancing device in an embodiment of the present invention.

Referring to FIG. 1, the foot balancing device in an embodiment of the present invention includes a shoe insert 10, a main balancing element 20, a first auxiliary force-transferring element 31, a second auxiliary force-transferring element 32, a first auxiliary balancing element 41, a third auxiliary force-transferring element 33, a second auxiliary balancing element 42, and a third auxiliary balancing element 43.

Figure 2:
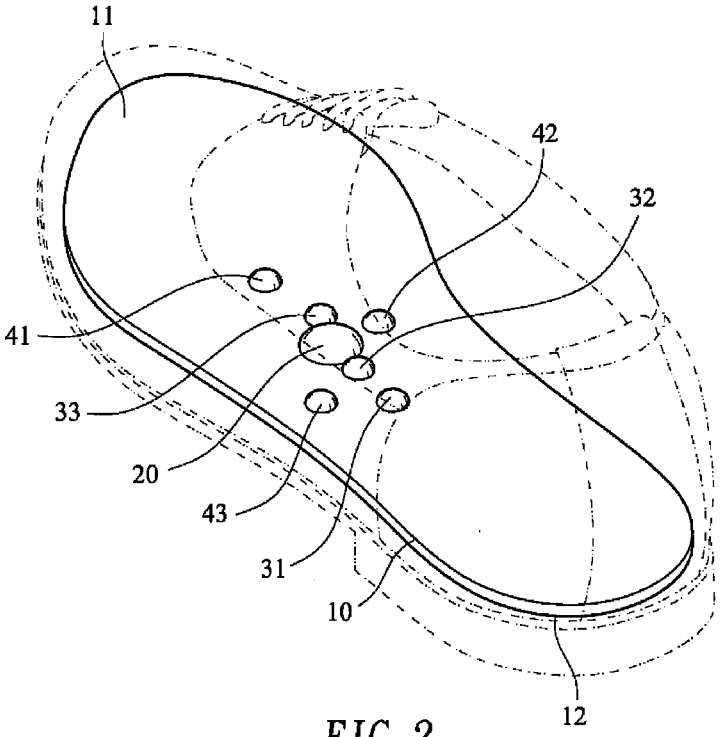
FIG. 2 schematically shows how the foot balancing device in FIG. 1 is placed in a shoe.

As shown in FIG. 2, the shoe insert 10 can be put into a shoe and functions as a cushioning structure between the sole of a person's foot and the shoe. The shoe insert 10 can be shaped to match the inner bottom surface of the shoe. In addition, the shoe insert 10 has an upper surface defined as a foot contact surface 11 for contact with the bottom surface of a human foot. The shoe insert 10 also has a lower surface defined as a bottom surface 12 for contact with the inner bottom surface of a shoe.

The shoe insert 10 defines a front-of-sole region 13, an arch region 14, and a heel region 15, which are sequentially arranged in the longitudinal direction of the shoe insert 10. When the sole of a human foot is in contact with the shoe insert 10, the front-of-sole region 13 of the shoe insert 10 corresponds in position to the front part of the sole; the arch region 14, to an arch of the foot; and the heel region 15, to the heel of the foot.

Referring to FIG. 1 and FIG. 2, the main balancing element 20; the first, second, and third auxiliary force-transferring elements 31, 32, 33; and the first, second, and third auxiliary balancing elements 41, 42, 43 are protuberances with a convex, circular, semicircular, or irregular surface. The main balancing element 20; the auxiliary force-transferring elements 31, 32, 33; and the auxiliary balancing elements 41, 42, 43 can be provided on the foot contact surface 11 or the bottom surface 12 of the shoe insert 10. As a healthy human foot in a standing position is typically supported at three points, namely the first and fifth metatarsal bones and the heel, and a foot arch tends to lack effective support because of its upwardly curved structure, the main balancing element 20; the auxiliary force-transferring elements 31, 32, 33; and the auxiliary balancing elements 41, 42, 43 are all provided in the arch region 14 of the shoe insert 10 to help a user adopt a balanced, proper posture naturally while standing or walking.

Figure 3:
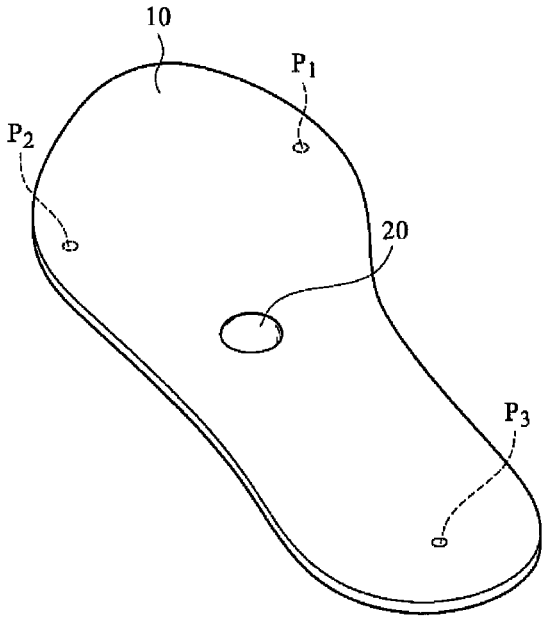
FIG. 3 schematically shows the foot balancing device in another embodiment of the present invention, wherein the foot balancing device only has the main balancing element.

As shown in FIG. 3, the main balancing element 20 is located at a geometric center between a first metatarsal bone point P1, a fifth metatarsal bone point P2, and a heel point P3 of the shoe insert 10, wherein the first metatarsal bone point P1 corresponds in position to the first metatarsal bone of the foot; the fifth metatarsal bone point P2, to the fifth metatarsal bone of the foot; and the heel point P3; to the heel of the foot. Thus, the main balancing element 20 is located at the gravity center of a human body while he or she is standing and can be used as a fulcrum on the shoe insert 10 for the front part of the sole of a foot and the heel of the foot. In practice, it is feasible that the shoe insert 10 is provided only with the main balancing element 20.

Figure 4:
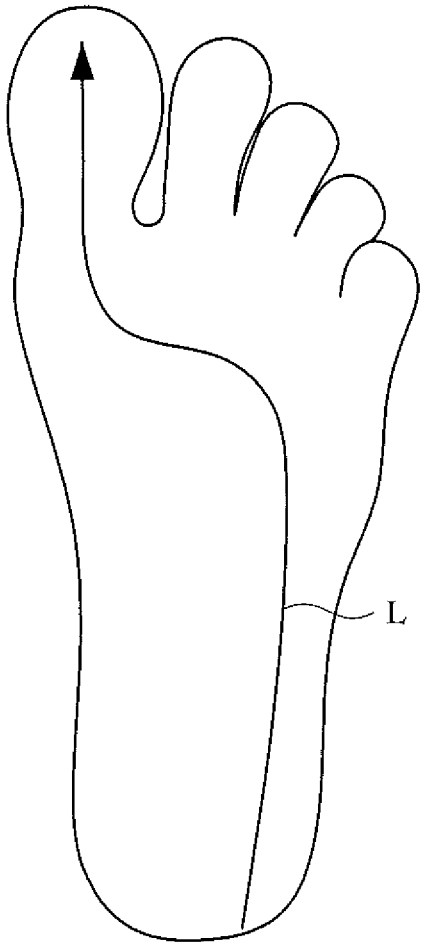
FIG. 4 schematically shows the line along which the center of pressure of the sole of a human foot is ideally moved while walking.

FIG. 4 schematically shows a line L along which the center of pressure of the sole of a human foot is ideally moved while walking. As a person walking on two feet lands the heel of the forward moving foot first, the gravity center of the person's body is moved in such a way that the center of pressure of the sole of the landing foot is displaced from the heel toward the toes. More particularly, the center of pressure first appears in an outer corner of the heel, then moves forward toward the toes, turns inward at a position adjacent to the fifth metatarsal bone, moves to the vicinity of the first metatarsal bone, and turns again toward the tip of the big toe, where the center of pressure disappears.

One who is walking with the center of pressure of each sole following the ideal line L has their body in the ideal walking state and can keep a proper posture while walking. By placing the main balancing element 20 at the geometric center between the first metatarsal bone point P1, the fifth metatarsal bone point P2, and the heel point P3, as shown in FIG. 3, it is ensured that the main balancing element 20 is located at the gravity center of the user's body while the user is standing and functions as an intermediate fulcrum between the heel and the front part of the sole while the user is walking, wherein the heels lands earlier than the front part of the sole.

In addition, the first, second, and third auxiliary force-transferring elements 31, 32, 33 are provided around the main balancing element 20 to facilitate displacement of the aforesaid center of pressure while the user is walking and consequently shifting the gravity center of his or her body. With the assistance of the auxiliary force-transferring elements 31, 32, 33, the user's body can maintain neutral balance in a natural manner, without improper movement or posture, thereby preventing soreness and chronic pain. Moreover, the first, second, and third auxiliary balancing elements 41, 42, 43 are provided to support a transverse arch, an inner arch, and an outer arch of a foot respectively so that the arch is firmly supported.

Referring back to FIG. 1, the first auxiliary force-transferring element 31 is provided rearward of the main balancing element 20 and is adjacent to the heel region 15, the second auxiliary force-transferring element 32 is provided on a line connecting the main balancing element 20 and the first auxiliary force-transferring element 31, the first auxiliary balancing element 41 is provided forward of the main balancing element 20 to support the transverse arch of a foot, the third auxiliary force-transferring element 33 is provided between the first auxiliary balancing element 41 and the main balancing element 20, the second auxiliary balancing element 42 is provided on one lateral side of the main balancing element 20 to support the inner arch, and the third auxiliary balancing element 43 is provided on the opposite lateral side of the main balancing element 20 to support the outer arch.

Figure 5:
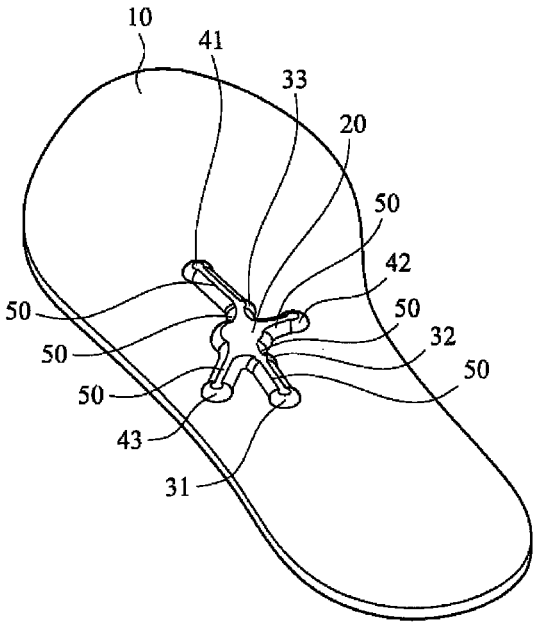
FIG. 5 schematically shows the foot balancing device in FIG. 1 further provided with connecting elements.

As shown in FIG. 1, the main balancing element 20; the first, second, and third auxiliary force-transferring elements 31, 32, 33; and the first, second, and third auxiliary balancing elements 41, 42, 43 can be provided on the shoe insert 10 all at once. Optionally, as shown in FIG. 5, connecting elements 50 can be provided to connect the adjacent ones of the main balancing element. 20; the first, second, and third auxiliary force-transferring elements 31, 32, 33; and the first, second, and third auxiliary balancing elements 41, 42, 43. That is to say, one connecting element 50 can be provided between the main balancing element 20 and each of the second auxiliary force-transferring element 32, the third auxiliary force-transferring element 33, the second auxiliary balancing element 42, and the third auxiliary balancing element 43; between the first auxiliary force-transferring element 31 and the second auxiliary force-transferring element 32; and between the first auxiliary balancing element 41 and the third auxiliary force-transferring element 33. In that case, the main balancing element 20; the first, second, and third auxiliary force-transferring elements 31, 32, 33; and the first, second, and third auxiliary balancing elements 41, 42, 43 are connected as a single unit and can be viewed as a single protuberant structure.

Figure 6:
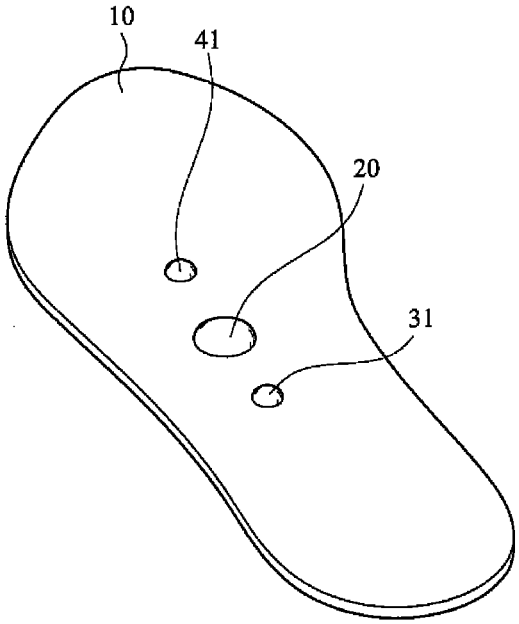
FIG. 6 schematically shows the foot balancing device in yet another embodiment of the present invention.
Figure 7:
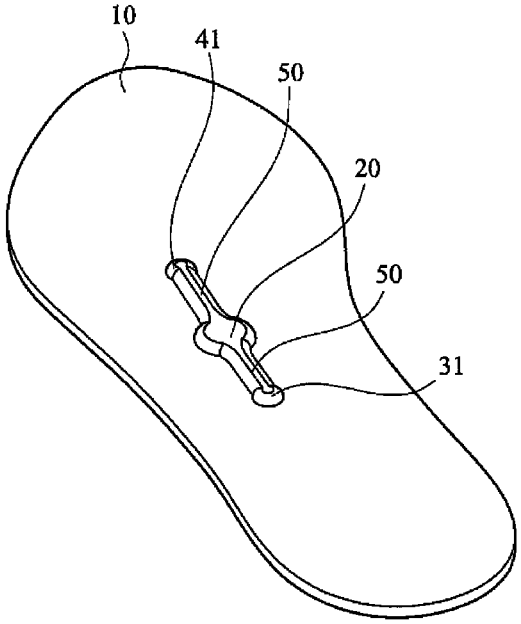
FIG. 7 schematically shows the foot balancing device in FIG. 6 further provided with connecting elements.

Apart from the structures described above, it is feasible to use only three of the foregoing protuberances to help a user maintain body balance. For example, referring to FIG. 6, the shoe insert 10 is provided only with the main balancing element 20, the first auxiliary force-transferring element 31, and the first auxiliary balancing element 41. Optionally, referring to FIG. 7, one connecting element 50 can be provided between the main balancing element 20 and each of the first auxiliary force-transferring element 31 and the first auxiliary balancing element 41 so that the main balancing element 20, the first auxiliary force-transferring element 31, and the first auxiliary balancing element 41 are connected as a single unit.

Figure 8:
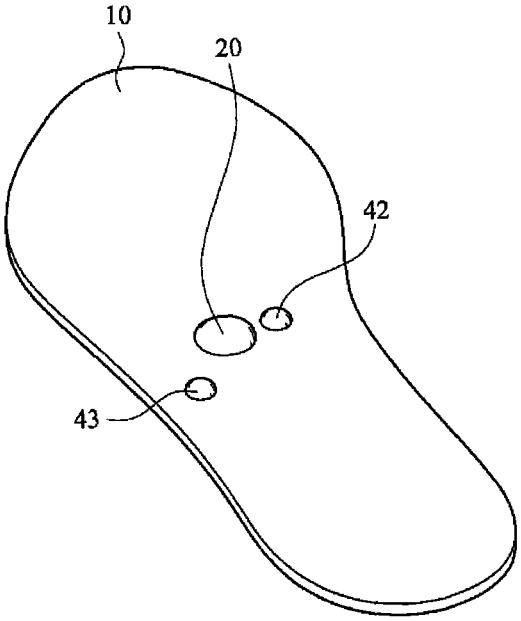
FIG. 8 schematically shows the foot balancing device in still another embodiment of the present invention.
Figure 9:
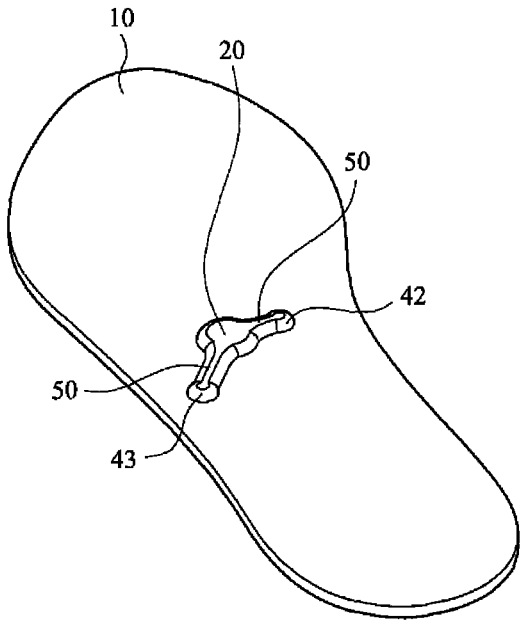
FIG. 9 schematically shows the foot balancing device in FIG. 8 further provided with connecting elements.

Alternatively, referring to FIG. 8, it is feasible that the shoe insert 10 is provided only with the main balancing element 20 and two auxiliary balancing elements 42, 43. In that case, the main balancing element 20 serves as a fulcrum for the front part of the sole of a user's foot and the heel of the foot while the auxiliary balancing elements 42, 43 support an inner arch and an outer arch respectively. Optionally, as shown in FIG. 9, one connecting element 50 can be provided between the main balancing element 20 and each of the two auxiliary balancing elements 42, 43 so that the main balancing element 20 and the two auxiliary balancing elements are connected as a single unit.

Figure 10:
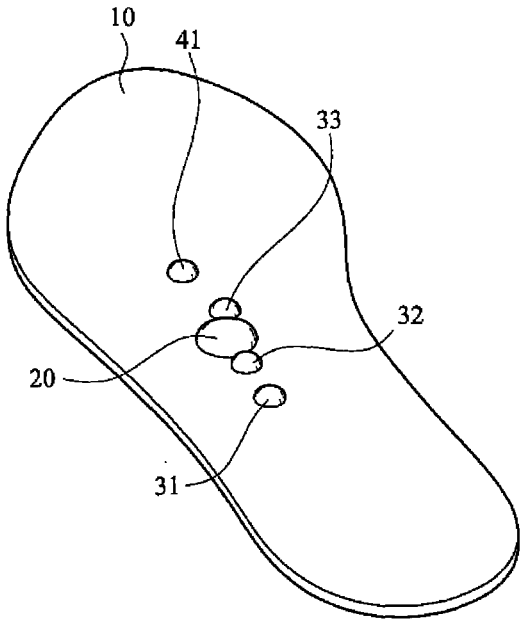
FIG. 10 schematically shows the foot balancing device in yet another embodiment of the present invention.

It is also feasible to use only five of the foregoing protuberances to help a user maintain body balance. For instance, as shown FIG. 10, only the main balancing element 20, the first auxiliary force-transferring element 31, the second auxiliary force-transferring element 32, the third auxiliary force-transferring element 33, and the first auxiliary balancing element 41 are provided. In that case, the main balancing element 20 serves as a fulcrum for the front part of the sole of a user's foot and the heel of the foot, the first auxiliary balancing element 41 is located forward of the main balancing element 20 to support a transverse arch, the first auxiliary force-transferring element 31 is located rearward of the main balancing element 20 and adjacent to the heel region, the second auxiliary force-transferring element 32 is located on a line connecting the main balancing element 20 and the first auxiliary force-transferring element 31, and the third auxiliary force-transferring element 33 is located between the first auxiliary balancing element 41 and the main balancing element 20.

Figure 11:
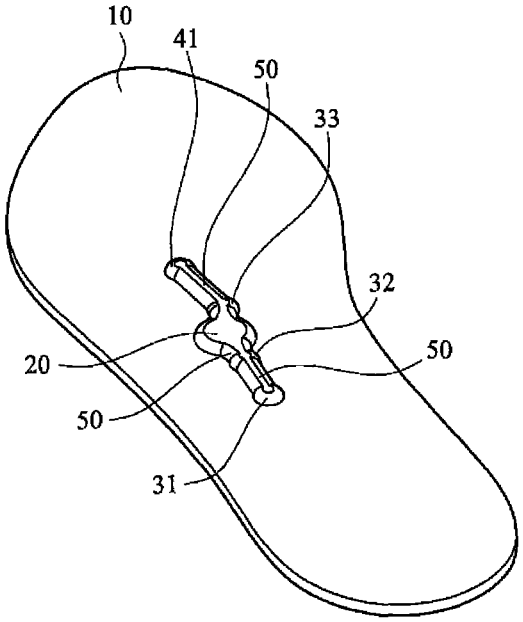
FIG. 11 schematically shows the foot balancing device in FIG. 10 further provided with connecting elements.

Optionally, referring to FIG. 11, an appropriate number of connecting elements 50 can be provided between the main balancing element 20, the first auxiliary force-transferring element 31, the second auxiliary force-transferring element 32, the third auxiliary force-transferring element 33, and the first auxiliary balancing element 41 to connect them together.

Figure 12:
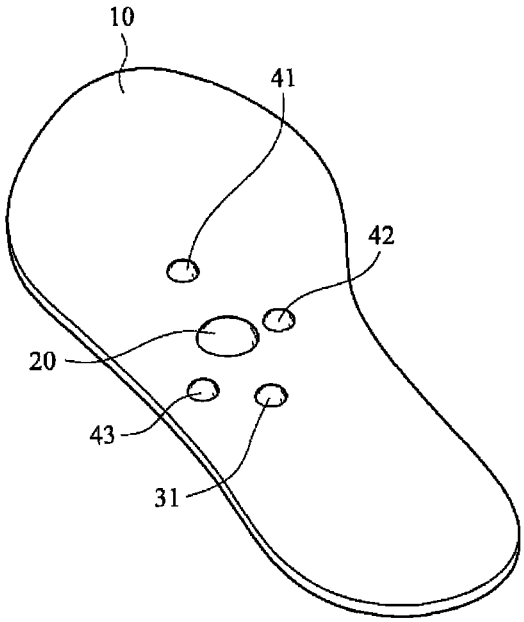
FIG. 12 schematically shows the foot balancing device in still another embodiment of the present invention.

Referring to FIG. 12, it is also feasible that only the main balancing element 20, the first auxiliary force-transferring element 31, the first auxiliary balancing element 41, the second auxiliary balancing element 42, and the third auxiliary balancing element 43 are provided. In that case, the main balancing element 20 functions as a fulcrum for the front part of the sole of a user's foot and the heel of the foot, the first auxiliary force-transferring element 31 is located rearward of the main balancing element 20 and adjacent to the heel region, the first auxiliary balancing element 41 is located forward of the main balancing element 20 to support a transverse arch of the foot, and the second auxiliary balancing element 42 and the third auxiliary balancing element 43 are respectively located on two lateral sides of the main balancing element 20 to support an inner arch and an outer arch of the foot respectively.

Figure 13:
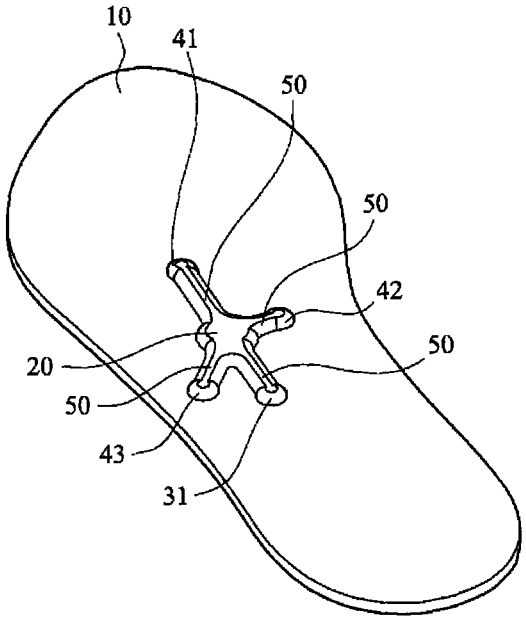
FIG. 13 schematically shows the foot balancing device in FIG. 12 further provided with connecting elements.

Optionally, as shown in FIG. 13, an appropriate number of connecting elements 50 can be provided between the main balancing element 20, the first auxiliary force-transferring element 31, the first auxiliary balancing element 41, the second auxiliary balancing element 42, and the third auxiliary balancing element 43 so that main balancing element 20, the first auxiliary force-transferring element 31, the first auxiliary balancing element 41, the second auxiliary balancing element 42, and the third auxiliary balancing element 43 are connected as a single unit.

The foot balancing device in each of the foregoing and other embodiments of the present invention can be used in various kinds of shoes and is adaptive to the foot shapes of the general public. By disposing the main balancing element 20 at a geometric center between the first metatarsal bone point P1, the fifth metatarsal bone point P2, and the heel point P3 of the shoe insert 10, the main balancing element 20 is located at the gravity center of a human body while he or she is standing and serves as a fulcrum on the shoe insert 10 for the front part of the sole of a foot and the heel of the foot. Moreover, the cross-sectional area of the main balancing element 20 can be greater than those of the auxiliary force-transferring elements 31, 32, 33 and the auxiliary balancing elements 41, 42, 43.

Besides, the relative positions of the auxiliary force-transferring elements 31, 32, 33 can be fine-tuned so that an ideal gait pattern can be achieved, and body balance maintained, as the gravity center of the body is displaced during walking. The auxiliary balancing elements 41, 42, 43, on the other hand, provide support for a transverse arch, inner arch and outer arch of the foot and help distribute the pressure on the foot for increased comfort.

The embodiments described above demonstrate that the main balancing element 20 can be used alone or in combination with different numbers of auxiliary force-transferring elements 31, 32, 33 and/or auxiliary balancing elements 41, 42, 43 according to practical needs, and whether seven, five, three, or only one of the disclosed protuberances is used, the foot balancing device of the present invention is equally effective in keeping body balance and providing optimal torque of the foot during walking, thereby maintaining dynamic as well as static equilibrium and comfort and noticeably alleviating soreness and chronic pain caused by improper posture.

The features of the present invention are disclosed above by the preferred embodiments to allow persons skilled in the art to gain insight into the contents of the present invention and implement the present invention accordingly. The preferred embodiments of the present invention should not be interpreted as restrictive of the scope of the present invention. Hence, all equivalent modifications or amendments made to the aforesaid embodiments should fall within the scope of the appended claims.

What is claimed is:

1. A foot balancing device, consisting of:

a shoe insert having a foot contact surface and a bottom surface, the shoe insert defining a front-of-sole region, an arch region, and a heel region sequentially arranged in a longitudinal direction of the shoe insert, the foot contact surface and the bottom surface each being a flat surface;

a main balancing element formed as a protuberance in the arch region and located on the shoe insert at a position corresponding to a fulcrum for a front part of a sole of a user's foot and a heel of the foot;

wherein the main balancing element is located in the arch region of the shoe insert corresponding to a geometric center between a first metatarsal bone point, a fifth metatarsal bone point, and a heel point of the shoe insert, wherein the main balancing element protrudes above the flat surface of the foot contact surface or protrudes below the flat surface of the bottom surface, and wherein the first metatarsal bone point corresponds in position to a first metatarsal bone of the foot, the fifth metatarsal bone point corresponds in position to a fifth metatarsal bone of the foot, and the heel point corresponds in position to the heel of the foot; and a first auxiliary force-transferring element and a first auxiliary balancing element, wherein the first auxiliary force-transferring element is formed as a protuberance in the arch region and is located rearward of the main balancing element and adjacent to the heel region, and the first auxiliary balancing element is formed as a protuberance in the arch region and is located forward of the main balancing element corresponding to a transverse arch of the foot, wherein a cross-sectional area of the main balancing element is greater than cross-sectional areas of each of the first auxiliary force-transferring element and a first auxiliary balancing element.

2. The foot balancing device of claim 1, further consisting of:

first connecting elements provided between the main balancing element and each of the first auxiliary force-transferring element and the first auxiliary balancing element, wherein the connecting elements correspondingly protruding above the flat surface of the foot contact surface or protrude below the flat surface of the bottom surface such that the main balancing element, the first auxiliary force-transferring element, and the first auxiliary balancing element are connected as a single protuberance.

3. The foot balancing device of claim 1, further consisting of:

two auxiliary balancing elements which are formed as protuberances in the arch region and which are located on two lateral sides of the main balancing element respectively corresponding to an inner arch and an outer arch of the foot respectively, wherein a cross-sectional area of the main balancing element is greater than cross-sectional areas of each of the two auxiliary balancing elements.

4. The foot balancing device of claim 3, further consisting of:

second connecting elements provided between the main balancing element and each of the auxiliary balancing elements, such that the main balancing element and the auxiliary balancing elements are connected as a single protuberance.

5. The foot balancing device of claim 1, further consisting of:

the first auxiliary force-transferring element, a second auxiliary force-transferring element, a third auxiliary force-transferring element, and the first auxiliary balancing element, wherein the second auxiliary force-transferring element is formed as a protuberance in the arch region and is located on a line connecting the main balancing element and the first auxiliary force-transferring element, and the third auxiliary force-transferring element is formed as a protuberance in the arch region and is located between the first auxiliary balancing element and the main balancing element, wherein a cross-sectional area of the main balancing element is greater than cross-sectional areas of each of the second auxiliary force-transferring element and the third auxiliary force-transferring element.

6. The foot balancing device of claim 5, further consisting of:

third connecting elements provided between adjacent ones of the main balancing element, the first auxiliary force-transferring element, the second auxiliary force-transferring element, the third auxiliary force-transferring element, and the first auxiliary balancing element, such that the main balancing element, the first auxiliary force-transferring element, the second auxiliary force-transferring element, the third auxiliary force-transferring element, and the first auxiliary balancing element are connected as a single protuberance.

7. The foot balancing device of claim 1, further consisting of:

the first auxiliary force-transferring element, the first auxiliary balancing element, a second auxiliary balancing element, and a third auxiliary balancing element, wherein the second auxiliary balancing element and the third auxiliary balancing element are formed as protuberances in the arch region and are located on two lateral sides of the main balancing element respectively corresponding to an inner arch and an outer arch of the foot respectively, wherein a cross-sectional area of the main balancing element is greater than cross-sectional areas of each of the second auxiliary balancing element, and the third auxiliary balancing element.

8. The foot balancing device of claim 7, further consisting of:

fourth connecting elements provided between adjacent ones of the main balancing element, the first auxiliary force-transferring element, the first auxiliary balancing element, the second auxiliary balancing element, and the third auxiliary balancing element, such that the main balancing element, the first auxiliary force-transferring element, the first auxiliary balancing element, the second auxiliary balancing element, and the third auxiliary balancing element are connected as a single protuberance.

9. The foot balancing device of claim 1, wherein the main balancing element protrudes above the flat surface of the foot contact surface.

10. The foot balancing device of claim 1, wherein the main balancing element protrudes below the flat surface of the bottom surface.

11. A foot balancing device, consisting of:

a shoe insert having a foot contact surface and a bottom surface, the shoe insert defining a front-of-sole region, an arch region, and a heel region sequentially arranged in a longitudinal direction of the shoe insert, the foot contact surface and the bottom surface each being a flat surface;

a main balancing element formed as a protuberance in the arch region and serving as a fulcrum on the front-of-sole region and the heel region of the shoe insert corresponding to a front part of a sole of a user's foot and a heel of the foot, respectively;

a first auxiliary force-transferring element formed as a protuberance in the arch region and located rearward of the main balancing element and adjacent to the heel region;

a second auxiliary force-transferring element formed as a protuberance in the arch region and located adjacent to the main balancing element and on a line connecting the main balancing element and the first auxiliary force-transferring element;

a first auxiliary balancing element formed as a protuberance in the arch region and located forward of the main balancing corresponding to a transverse arch of the foot;

a third auxiliary force-transferring element formed as a protuberance in the arch region and located adjacent to the main balancing element and between the first auxiliary balancing element and the main balancing element;

a second auxiliary balancing element formed as a protuberance in the arch region and located on a lateral side of the main balancing element corresponding to an inner arch of the foot; and a third auxiliary balancing element formed as a protuberance in the arch region and located on an opposite lateral side of the main balancing element corresponding to an outer arch of the foot;

wherein the main balancing element, the first auxiliary force-transferring element, the second auxiliary force-transferring element, the first auxiliary balancing element, the third auxiliary force-transferring element, the second auxiliary balancing element and the third auxiliary balancing element protrude above the flat surface of the foot contact surface or protrude below the flat surface of the bottom surface, wherein the main balancing element is located in the arch region of the shoe insert corresponding to a geometric center between a first metatarsal bone point, a fifth metatarsal bone point, and a heel point of the shoe insert, wherein the protuberance of the main balancing element is formed larger than the protuberances of the first auxiliary force-transferring element, the second auxiliary force-transferring element, the first auxiliary balancing element, third auxiliary force-transferring element, the second auxiliary balancing element and the third auxiliary balancing element, and wherein the first metatarsal bone point corresponds in position to the first metatarsal bone of the foot, the fifth metatarsal bone point corresponds in position to the fifth metatarsal bone of the foot, and the heel point corresponds in position to the heel of the foot.

12. The foot balancing device of claim 11, further consisting of:

connecting elements provided each between the main balancing element and the first auxiliary force-transferring element, between the main balancing element and the second auxiliary force-transferring element, between the main balancing element and the first auxiliary balancing element, between the first auxiliary balancing element and the third auxiliary force-transferring element, between the main balancing element and the second auxiliary balancing element, and between the main balancing element and the third auxiliary balancing element, and the connecting elements correspondingly protrude above the flat surface of the foot contact surface or protrudes below the flat surface of the bottom surface such that the main balancing element, the first auxiliary force-transferring element, the second auxiliary force-transferring element, the first auxiliary balancing element, the third auxiliary force-transferring element, the second auxiliary balancing element, and the third auxiliary balancing element with the connecting elements therebetween are formed as a single protuberance.

13. The foot balancing device of claim 11, wherein the protuberance of the main balancing element is formed with a diameter larger than diameters of the protuberances of the first auxiliary force-transferring element, the second auxiliary force-transferring element, the first auxiliary balancing element, third auxiliary force-transferring element, the second auxiliary balancing element and the third auxiliary balancing element.

* * * * *